United States Patent [19]

Epps

[11] 4,148,351

[45] Apr. 10, 1979

[54] MOLD TUBE ALIGNMENT DEVICE

[75] Inventor: Harold R. Epps, Selkirk, Canada

[73] Assignee: Dominion Bridge Company, Limited, Montreal, Canada

[21] Appl. No.: 780,839

[22] Filed: Mar. 24, 1977

Related U.S. Application Data

[63] Continuation of Ser. No. 578,273, May 16, 1975, abandoned.

[30] Foreign Application Priority Data

Feb. 10, 1975 [CA] Canada ..... 219723

[51] Int. Cl.[2] ..... B22D 11/00

[52] U.S. Cl. ..... 164/150; 29/271; 164/418

[58] Field of Search ..... 29/271, 272, 407, 468, 29/464; 164/82, 418, 441, 442, 447, 425, 445, 413, 137, 342, 412, 4, 150

[56] References Cited

U.S. PATENT DOCUMENTS 2,849,906 9/1958 Loveless ..... 29/272 X 3,550,672 12/1970 Fastert et al. ..... 164/418

3,757,405 9/1973 Kurth et al. ..... 164/418 X

*Primary Examiner*—Francis S. Husar

*Assistant Examiner*—Mark Rosenbaum

*Attorney, Agent, or Firm*—Larson, Taylor and Hinds

[57] ABSTRACT

A method and device are disclosed for aligning up a pouring mold tube in a continuous casting machine. The device has a mold insert portion having a pair of parallel faces which mate with the vertical parallel internal walls of a mold tube. A vertical alignment means is attached to the top of the mold insert portion and is adapted to indicate when the mold insert portion and hence the mold tube is in a vertical position. A radial and horizontal alignment means is also attached to the mold insert portion and is adapted to indicate when the mold insert portion and the mold tube are radially and horizontally aligned. The method includes the steps of inserting a mold insert portion of an alignment device between the vertical parallel walls of a mold tube and adjusting the elevation of the adaptor plate supporting the mold tube such that the alignment device is aligned vertically, radially and laterally.

10 Claims, 9 Drawing Figures

MOLD TUBE ALIGNMENT DEVICE

This application is a continuation of my previous application, Ser. No. 578,273, filed May 16, 1975, now abandoned.

This invention relates to a continuous casting apparatus for casting solid billets. More particularly, this invention relates to a device for vertically, laterally and radially aligning a solid pouring mold mounted on an oscillating table of a continuous casting machine.

In all types of continuous casting apparatus, molten metal is converted to a solid billet in a bottomless solid copper mold tube. The mold tube is positioned below a metered stream of molten metal and is contained in a cooling jacket through which a high volume of cooling water is passed. The cooling jacket and mold are adjustably mounted on an oscillating mold table. The billet continuously withdrawn from the bottom of the mold tube has a solidified shell with molten metal still contained therein. Some continuous casting apparatus are vertical systems in which the billet passes vertically downwards and is cooled continuously by water sprays. Then, when it has solidified the billet is cut into predetermined lengths. Another type of continuous casting apparatus is the curved mold type as shown in FIG. 1, wherein the copper mold tube has a curve therein and the billet passing from the mold tube follows the curve and is guided by a series of rollers through an angle of 90° to a straightener withdrawal unit which straightens the continuous billet and cuts it into predetermined lengths.

A continuous pour generally lasts for one to one and a half hours during which time approximately 25 tons per mold of metal may be formed into predetermined billet lengths. After a certain number of pours, wear occurs in the mold tube, and it is necessary to replace it. This replacement step requires the new mold tube to be accurately aligned with the rest of the machine. Any misalignment that exists between the mold tube and the casting machine can cause undue stresses to occur on the thin shell of the billet around the molten metal contained therein as the billet leaves the bottom of the mold tube. Undue stresses have a number of consequences ranging from a distorted billet with internal faults to a rupture or break-out of the molten metal from the shell. Break-outs cause metal to spill into the machine which terminates the process and results in considerable clean-up before the casting process can be restarted.

The mold tube and cooling jacket are generally formed together as one unit which can be removed from the mold adjusting plate on the machine and replaced by another unit so that the casting machine can continue operating while the old mold tube unit is returned to a maintenance shop for repair. In this manner mold tube units can be repaired and maintained at leisure and without holding up the process of casting. Furthermore, the size of mold tube can vary to allow various size ranges of billets to be cast. For different sized billets, different sized mold tubes must be installed. In practice it is found that mold tubes are never positioned in exactly the same place in the mold tube units. Thus, every time a new mold tube unit is placed into a continuous casting machine it is necessary to realign the adjusting plate mounted on the oscillating table. In the past the alignment has often caused some problems because the mold tube was positioned by aligning up the outside of the cooling jacket with the casting machine. However, the inside of the mold tube is frequently out of alignment with the outside of the cooling jacket and thus true alignment of the mold tube with the machine was often not achieved. Consequently, casts sometimes produced distorted billets which are not the correct weight and this in turn causes considerable problems in the rolling of the billets into rolled sections.

It is an object of the present invention to provide an alignment device to align up the internal surfaces of a mold tube with a continuous casting machine.

It is a further object of the present invention to provide an alignment tool to align a mold tube in a continuous casting machine, the device being one which is easy to install into the mold tube.

These and other objects of the present invention are accomplished by providing a device for aligning up a pouring mold tube in a continuous casting machine wherein the mold tube has at least one pair of vertical parallel internal walls and is surrounded by a mold cooling jacket both connected to an adjusting plate which is adjustably mounted on an oscillating table, the device comprising: a mold insert portion having a pair of parallel faces adapted to mate with one pair of vertical parallel internal walls in the mold tube, a vertical alignment means attached to the top of the mold insert portion adapted to indicate when the mold insert portion and hence the mold tube is in a vertical position and a radial and horizontal alignment means attached to the mold insert portion adapted to indicate when the mold insert portion and hence the mold tube is radially and laterally aligned.

The advantage of this invention both as to its construction will be readily appreciated as the same becomes better understood by reference to the following detailed description when considered in connection with the accompanying drawings which illustrate an embodiment of the invention.

Figures 1, 2:
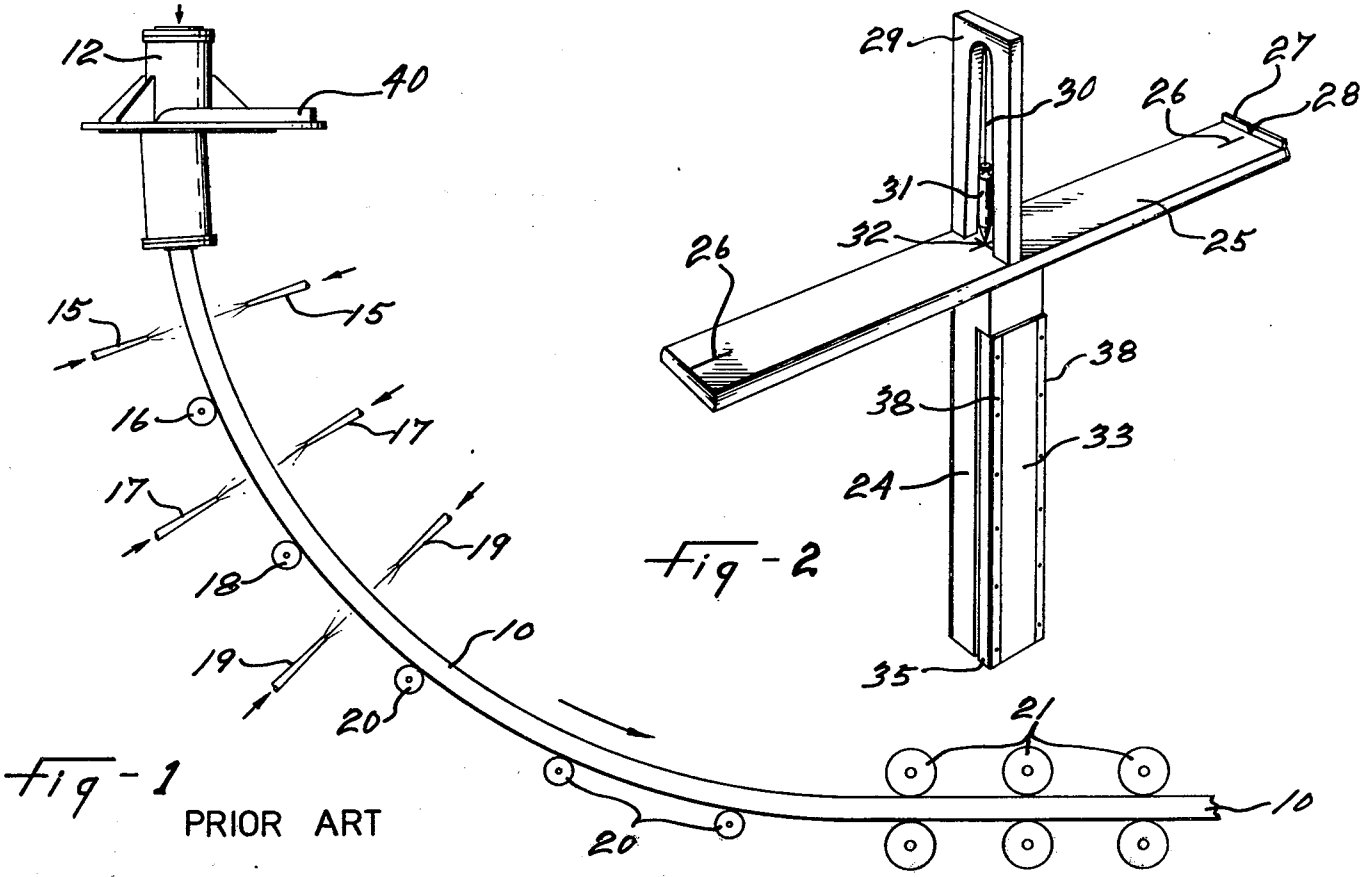
FIG. 1 shows a schematic side elevation of a curved mold continuous casting machine of the type known in the prior art, with a partial cross-section through the mold tube.
FIG. 2 shows a perspective view of an alignment device suitable for aligning a mold tube in a continuous casting machine.

Referring now to the drawings, a continuous casting machine of the curved mold type is shown in FIG. 1, with a continuous steel billet 10 issuing from a curved mold tube 11 (FIG. 3) located in a mold cooling jacket 12. The mold tube 11 is preferably made from copper to transfer the heat from the molten metal within the mold tube 11 to water which passes through the cooling jacket 12. The cooling jacket is attached to an adjusting plate 13 (FIG. 3) which in turn is adjustably mounted on an oscillating table 14. In the embodiment shown in FIG. 1 the radius of the machine is 22 feet: that is to say, the arc formed by the billet 10 as it issued from the mold 11 (FIG. 3), located in cooling jacket 12, and is fed over and aligned with rollers 16, 18, 20 and 21, has a 22-foot radius of curvature throughout the length of billet 10. The oscillating table 14 oscillates about this curved radius to assist the billet 10 leaving the mold 11 and ensure the billet 10 does not deviate from the path of the curved radius. The billet 10 leaving the mold 11 passes through a first spray zone, where water sprays 15 cool the billet, over a first roller 16 to a second spray zone, where water sprays 17 cool the billet further, over a second roller 18 to a third spray zone, where water sprays 19 cool the billet still further. The billet 10 then passes over three further rolls 20 so that it follows its normal curve, and finally passes through three pairs of horizontal straightening rolls 21 in tandem to remove the curve from the billet 10. After this the straightened billet is cut to the required lengths, cooled and stored. Subsequently, billet lengths can be reheated for further processing into rolled sections.

Figure 3:
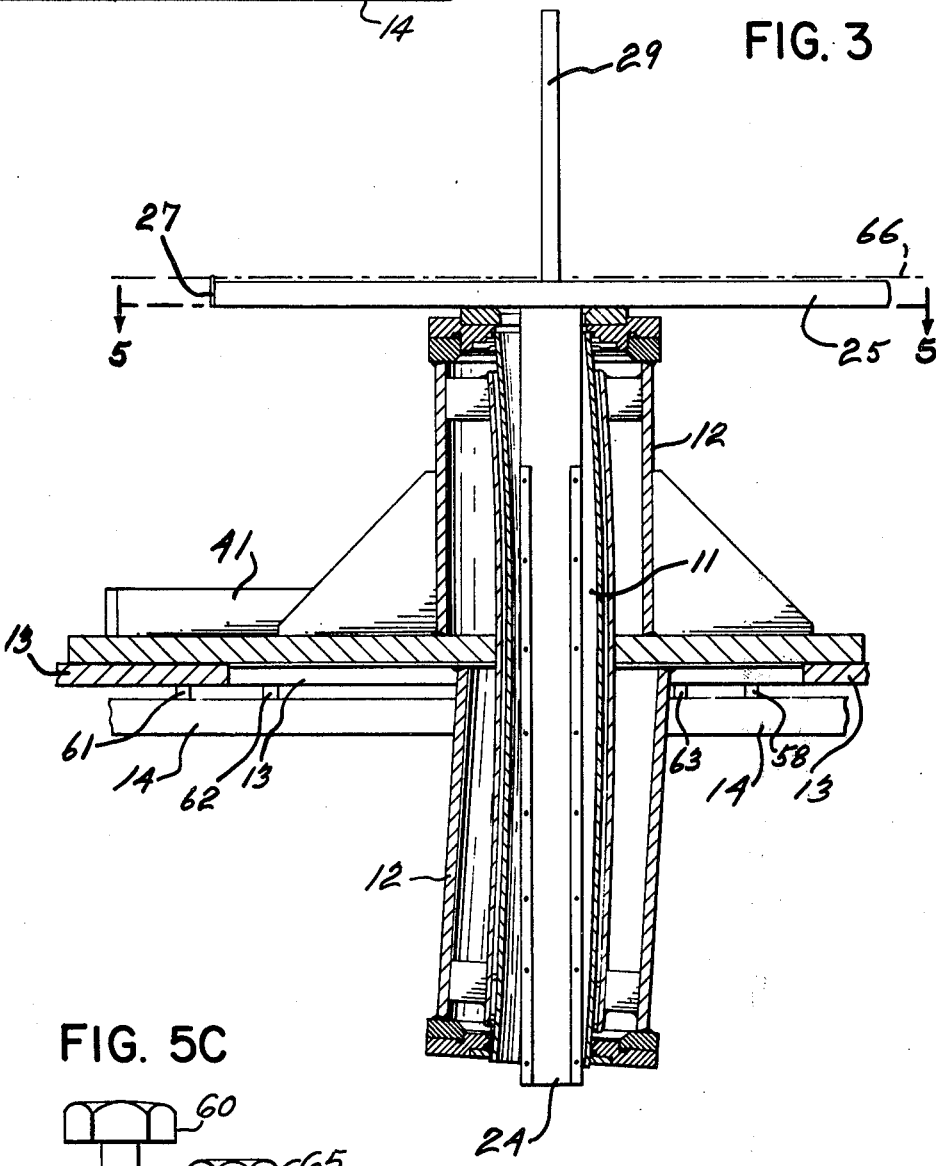
FIG. 3 shows a cross-sectional side elevation through the centre of a mold tube of a casting machine similar to that shown in FIG. 1, with the alignment device of FIG. 2 positioned in the mold tube.

In operation molten steel is poured from a ladle into a refractory-lined vessel referred to as a tundish which has a nozzle with a flow control valve positioned directly over the centre of the mold tube 11 (FIG. 3). When starting up the operation a dummy bar is plugged into the base of the mold tube 11 and a metered stream of molten steel pours through the tundish nozzle into the mold tube 11. Water is passed through the mold cooling jacket 12, preferably at a high volume rate in the order of 400 to 500 gallons per minute. The oscillation table 14 (FIG. 3) oscillates in a stroke which conforms to the radius of the casting machine and the dummy bar is slowly withdrawn through first, second and third spray zones to the three pairs of horizontal straightening rolls 21 in tandem. As the dummy bar is withdrawn, the steel billet forms behind it and once the billet has reached the three pairs of straightening rolls 21 the speed of withdrawal is then controlled by the rolls 21. The metered stream of molten steel falls about 14 inches into the top of the mold tube 11. When the billet 10 is withdrawn from the bottom of mold tube 11 it has a solidified steel shell from $\frac{1}{2}''$ to $\frac{3}{8}''$ thick which contains the molten metal therein. This molten metal solidifies as the billet 10 cools by passing through the three spray zones.

Different sizes of billets may be poured by merely changing the size of mold tube 11 and varying the metered flow of molten steel into the mold tube 11 from the tundish. For example, billet sizes range from $4''\times4''$ square through $5\frac{1}{4}''\times5\frac{1}{4}''$ and $6\frac{3}{4}''\times6\frac{3}{4}''$ to $7\frac{5}{8}''\times7\frac{5}{8}''$. A continuous pour generally lasts for one to one and a half hours depending on the size of the billet and the amount of steel in the tundish. After every hundred casts it is generally necessary to change the mold as a certain amount of wear occurs with the steel billet solidifying within the mold and then being withdrawn as the reciprocating table continually moves the mold tube 11 up and down.

One embodiment of the alignment device is shown in FIG. 2. The device is in the general configuration of a cross, the lower vertical portion being the mold insert portion 24 which is the portion for inserting inside the mold tube 11. The alignment device shown fitting inside a mold tube may be seen in FIGS. 3, 4, 5 and 6. The mold insert portion 24 has a generally rectangular cross-section and extends downwards so that it is at least as long as the depth of the mold tube 11. An elongate member 25 forms the horizontal arms of the cross configuration and is securely mounted above the mold insert portion 24. Thus, when the device is inserted into the mold tube 11 the elongate member 25 rests on the top edge of the mold tube 11 to assure that the alignment device is aligned relative to the mold tube 11. The elongate member 25 is rectangular in shape as shown in FIG. 2. At each end of the arms of the elongate member 25 is a mark 26 in the centre. As also shown in FIG. 2 a mounted strip 27 with a V-notch 28 therein is located at the outside end of one arm of the elongated member 25. The V-notch 28 is positioned in line with the two marks 26. The top vertical arm of the cross configuration is formed into a slender arch 29 extending upwards from the centre of the elongate member 25 having a flexible elongated element 30 such as string or wire suspended from the top centre of the arch 29 and a plumb bob 31 attached to the end of the flexible elongate element 30. A cross 32 is marked on the top surface of the elongate member 25 directly beneath the plumb bob 31 such that when the plumb bob is hanging vertically, the tip of the plumb bob 31 points to the very centre of the cross 32.

Figure 6:
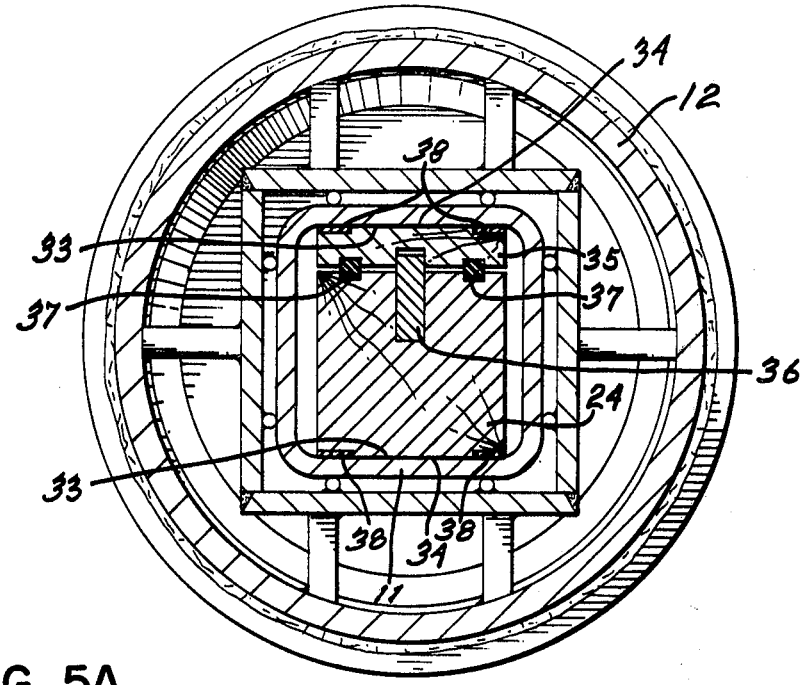
FIG. 6 shows a cross-section through the mold tube having the alignment device positioned therein taken at line 6—6 of FIG. 4.

The mold insert portion 24 has two parallel faces 33 which fit between the vertical faces 34 of the mold tube 11 as shown in FIG. 6. In order to insure that these parallel faces 33 of the mold insert portion 24 press against the vertical walls 34 of the mold tube 11 a separate member 35 is spaced from the main portion of the mold insert portion 24. This separate member 35 is held to the mold insert portion 24 by means of dowels 36 as shown in FIG. 6 and has two round rubber rods 37 extending vertically for the length of the separate member 35. These round rubber rods 37 compress when the mold insert portion 24 is pushed into the top of a mold tube 11 to insure there is always pressure against the vertical sides 34 of the mold tube 11. It will be appreciated that although only the one embodiment showing two rubber rods is illustrated, other compressible rubber inserts or even a single insert may be used. Also, steel springs may perform the same function. The separate member 35 is removable from the mold insert portion 24. Thus, several sizes of separate members 35 may be made available for fitting to the same mold insert portion 24 of the alignment device, to take into account different internal dimensions of the mold tube 11. For example, a $4''\times4''$ internal dimension mold tube would have a slim separate member 35 whereas a $6\frac{3}{4}''\times6\frac{3}{4}''$ internal dimension mold tube would have a considerably thicker separate member 35.

The alignment device is generally made from wood. However, in order to avoid wear it is common to fit brass inserts 38 (FIGS. 2 and 6) on each corner of the mold insert portion 24 so that when the mold insert portion 24 is inserted into the mold tube 11 the wood of the mold insert portion does not wear, and the alignment of the device within the mold tube remains true. In a preferred embodiment the elongate member 25 is made from wood and has a half round section of aluminum around it to protect the wood.

Figure 5B:
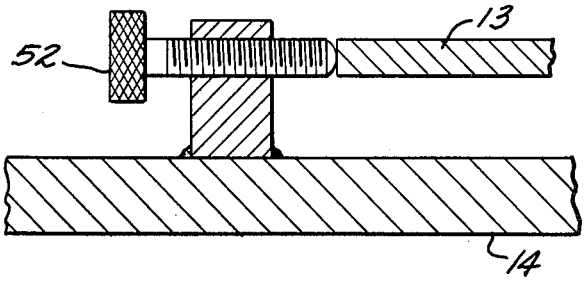
FIG. 5B shows a sectional side elevation of a horizontal set screw taken along line 5B—5B in FIG. 5A.
Figure 5C:
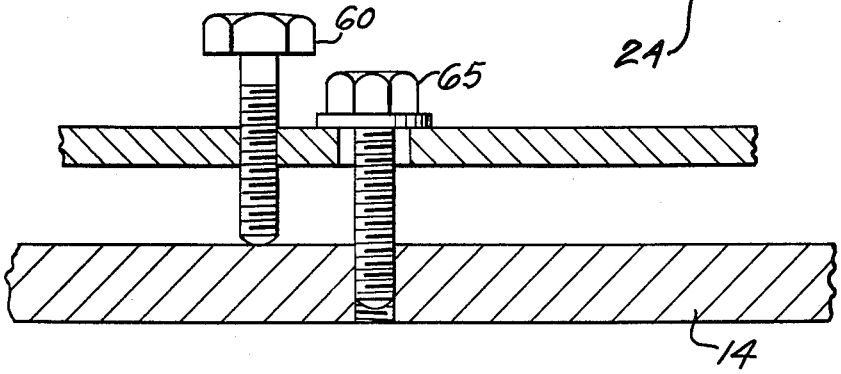
FIG. 5C shows a sectional side elevation of a hold-down bolt and a jacking screw taken along line 5C—5C in FIG. 5A.
Figure 4:
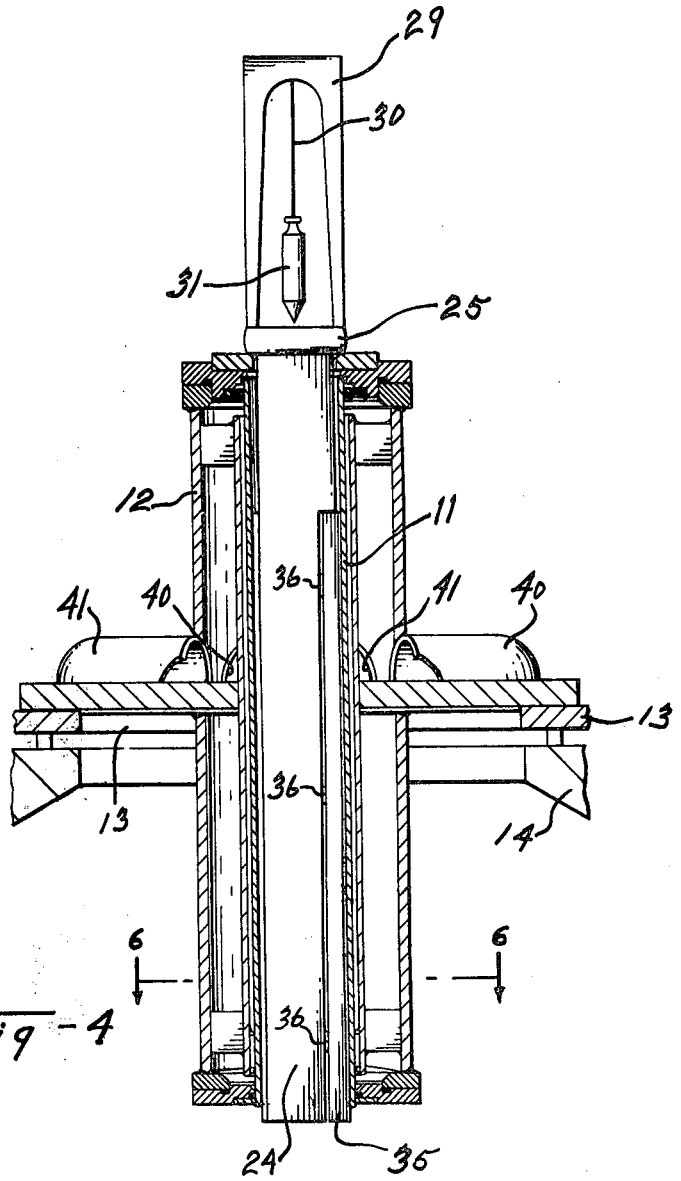
FIG. 4 shows a cross-sectional end elevation through the centre of a mold tube and alignment device shown in FIG. 3.
Figure 5:
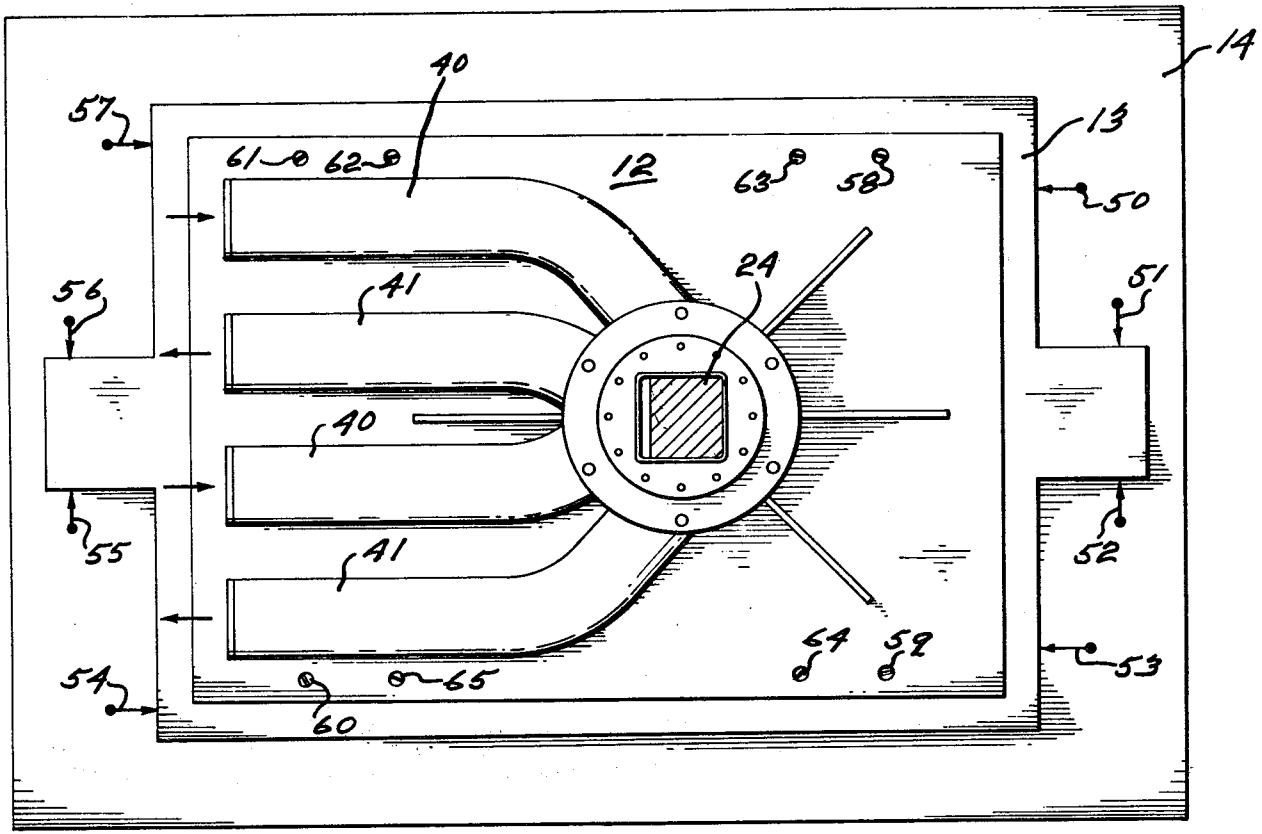
FIG. 5 shows a plan view of the mold cooling jacket, adjusting plate and oscillating table with the alignment device positioned therein taken at line 5—5 of FIG. 3.
Figure 5A:
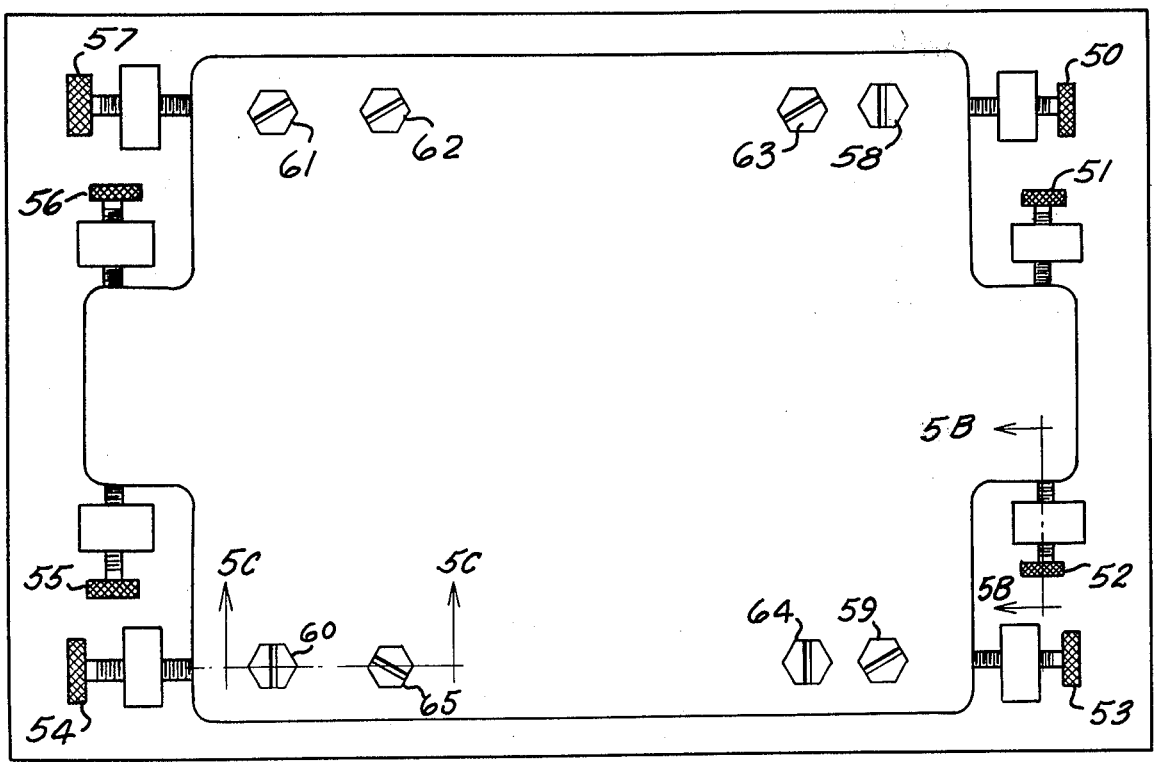
FIG. 5A shows a plan view similar to FIG. 5, but with the mold cooling jacket removed, and the hold-down bolts, the jacking screws, and the horizontal set screws shown in greater detail.

The mold cooling jacket 12 surrounding the mold tube 11 has water inlets 40 and water outlets 41, as shown in FIG. 5. Flexible hoses (not shown) are attached to the inlets and outlets so that the water supply to the cooling jacket 12 may be supplied while the mold tube is being reciprocated on the oscillating table 14. Cooling water in the order of 400 to 500 gallons per minute is passed through the cooling jacket 12 while the casting process is underway. The mold tube 11 (FIG. 3) is generally a press-fit within an inner sleeve of the mold cooling jacket 12 and may be removed in a maintenance area and a new one replaced as required. Eight horizontal set screws 50–57, as shown in FIG. 5 and 5A (FIG. 5B shows a sectioned side elevation of set screw 52) provide horizontal adjustment of the adjusting plate 13 onto the oscillating table 14. Four jacking screws 58–61, shown in FIGS. 5 and 5A (FIG. 5C shows a sectional side elevation of screw 60) provide the vertical adjustment for the adjusting plate 13 and four hold-down bolts 62–65, which pass though oversize apertures in adjusting plate 13, are tightened down after the plate 13 has been aligned both vertically and radially in the casting machine.

In order to align a new adjusting plate 13, mold cooling jacket 12 and mold tube 11 unit onto an oscillating table 14, (FIGS. 3 and 5) it is first necessary to back off all the horizontal set screws 50–57, (FIG. 5) release the hold-down bolts 62–65 and then insert the alignment device into the mold tube 11. Next, insure that the parallel faces 33 of the mold insert portion 24 are pressed up against the vertical walls 34 of the mold tube 11. It is also necessary to insure that the mold insert portion 24 is pushed down into the mold tube 11 so that the elongate member 25 rests on the top edge of the mold tube 11 and is aligned vertically with the mold tube 11. The next step is to adjust the four jacking screws 58–61 so that the tip of the plumb bob 31 is exactly over the centre of the cross 32 on the elongate member 25. This assures that the mold tube 11 is vertically aligned in the casting machine. The next step is to align the mold tube 11 up radially and horizontally with the casting machine and this is done by stringing a horizontal elongate element such as a wire 66 (shown as a broken line in FIG. 3) horizontally from two permanent positions, one on each side of the mold tube 11 that are connected and/or permanently located with regard to the position of the casting machine. More specifically, these two permanent positions should always be in the same alignment with respect to the rollers 16, 18, 20 and 21. The wire 66 is so positioned as to pass through the arch 29 of the alignment device and is tightened to give a straight data line on which to check alignment. The horizontal set screws 50–57 are then adjusted to rotate and laterally move the mold tube 11 as necessary so that the horizontal wire 66 lies in the centre of the V-notch 28 of the mounted strip 27 and the wire 66 is exactly in line with the two marks 26 on the elongate member 25. When these marks are in alignment with the wire 66 then the mold tube 11 is aligned radially and horizontally and the alignment device has performed its duty. Before tightening down the hold-down bolts 62–65 another alignment is required to insure that the curve of the mold tube 11 is in line with the curve of the casting machine. This alignment is done by another device which does not form part of the present invention. After the curve alignment the hold-down bolts 62–65 are tightened and the mold tube 11 is aligned, ready to receive the molten metal. Horizontal set screws 50–57, jacking screws 58–61, and hold-down bolts 62–65 are well known in the art. Further it is to be understood that other devices known in the art can be used to position adjusting plate 13 relative to oscillating table 14.

Further changes may be made to the alignment device without departing from the scope of the present invention. In one particular case, the rubber rods 37 (FIG. 6) may be replaced by a threaded expansion means. This incorporates a threaded bolt extending vertically downwards through the mold insert portion 24 and upon being turned this pushes the separate member 35 against the vertical walls 34 of the mold tube 11, thus giving a more positive hold between the mold insert portion 24 and the mold tube 11. Another embodiment that may be incorporated is the use of optics to line up the two marks 26 on the elongate member 25. A high intensity light source may be used to replace the wire 66 presently in use and this avoids having to string the wire 66 between two fixed positions adjacent the casting machine.

I claim:

1. A device for aligning a billet issued from a continuous casting machine with billet receiving rollers positioned along an arc comprising:
   - a pouring mold tube in the continuous casting machine, wherein said mold tube has at least one pair of vertical parallel internal walls;
   - a mold cooling jacket surrounding said mold tube;
   - an adjusting plate connected to said mold tube and said cooling jacket for adjusting the position of said mold tube relative to the rollers;
   - an oscillator table to which said adjusting plate is adjustably mounted;
   - a mold insert portion having a pair of parallel faces operatively associated with one pair of vertical parallel internal walls in said mold tube;
   - a vertical alignment means attached to the top of said mold insert portion which indicates when said mold insert portion and hence said mold tube is in a vertical position; and
   - a radial and horizontal alignment means attached to said mold insert portion which indicates when said mold insert portion and hence said mold tube is radially and horizontally aligned;
   - so that the billet issued from said mold tube is aligned so as to be received by the arcuately positioned rollers.

2. The device according to claim 1 wherein the mold insert portion has a rectangular cross-section and further comprising:
   - a separate member wherein one of the pair of parallel faces is mounted on said separate member spaced from the other parallel face mounted on the remainder of the mold insert portion, said separate member pressing the parallel faces against the vertical parallel internal walls of the mold tube when inserted therein.

3. The device as claimed in claim 2 wherein the separate member is spaced apart from the remainder of the mold insert portion by at least one compressible rubber insert.

4. The device as claimed in claim 2 wherein the separate member is spaced apart from the remainder of the mold insert portion by a threaded expansion means pressing the parallel faces against the vertical parallel internal walls of the mold tube when inserted therein.

5. The device as claimed in claim 2 wherein the separate member is removable from the mold insert portion which mounts the other parallel face and a plurality of separate members having different thicknesses may be attached one at a time to the mold insert portion allowing the mold insert portion to be fitted to different sizes of mold tubes.

6. The device as claimed in claim 1 wherein the vertical alignment means includes a plumb bob attached to a flexible elongate element supported from an extension member, said extension member mounted to the mold insert portion so as to be positioned above the mold insert portion, the plumb bob aligning with a pre-set mark when the mold insert portion and hence the mold tube is vertically aligned.

7. The device as claimed in claim 1 wherein the radial and horizontal alignment means includes an elongated member perpendicular to the mold insert portion, the elongated member having a mark at each end thereof, the marks aligning with a horizontal elongated element securable to the continuous casting machine to indicate radial and horizontal alignment of the mold insert portion and hence the mold tube.

8. The device as claimed in claim 1 wherein the vertical alignment means includes a plumb bob attached to a flexible elongate element supported from an extension member, said extension member mounted to the mold insert portion so as to be positioned above the mold insert portion, the plumb bob aligning with a pre-set mark when the mold insert portion and hence the mold tube is vertically aligned, and the radial and horizontal alignment means includes an elongated member perpendicular to the mold insert portion, the elongated member having a mark at each end thereof, and marks aligning with a horizontal elongated element securable to the continuous casting machine to indicate radial and horizontal alignment of the mold insert portion and hence the mold tube.

9. A device for aligning a pouring mold tube in a curved mold type continuous steel casting machine to allow a billet issued from the mold tube to be aligned with billet receiving rollers positioned along an arc, wherein such a mold tube has a pair of vertical parallel internal walls and is surrounded by a mold cooling jacket both connected to an adjusting plate which is adjustably mounted on an oscillating table, the device comprising a mold insert portion having a rectangular cross-section and a pair of parallel faces which are capable of pressing with such a pair of vertical parallel internal walls in the mold tube, the mold insert portion including a separate member, one of the pair of parallel faces being on said separate member spaced from the remainder of the mold insert portion, and which are capable of pressing the parallel faces against such vertical parallel internal walls of such a mold tube when inserted therein, a plumb bob attached to a flexible elongated element supported from an extension member, said extension member mounted to the mold insert portion so as to be positioned above the mold insert portion, the plumb bob aligning with a preset mark when the mold insert portion and hence the mold tube is vertically aligned, and an elongated member perpendicular to the mold insert portion, the elongated member having a mark at each end thereof, the marks being aligned with a horizontal elongate element securable to the continuous casting machine to indicate radial and horizontal alignment of the mold insert portion and hence the mold tube so that the billet issued from the mold tube is aligned with the arcuately positioned billet receiving rollers.

10. A device for aligning each of a plurality of different sizes of pouring mold tubes in a curved mold type continuous steel casting machine to allow a billet issued from the mold tube to be aligned with billet receiving rollers positioned along an arc, wherein such a mold tube has a pair of vertical parallel internal walls and is surrounded by a mold cooling jacket both connected to an adjusting plate which is adjustably mounted on an oscillating table, the device comprising a mold insert portion having a rectangular cross-section and a pair of parallel faces which operably mate with the pair of vertical parallel internal walls in the mold tube, the mold insert portion including a separate member, one of the pair of parallel faces being on said separate member, said mold insert portion including means for spacing said separate member from the remainder of the mold insert portion, said spacing means presses the parallel faces against the vertical parallel internal walls of the mold tube when inserted therein, wherein the separate member is removable from the mold insert portion and a plurality of separate members having different thicknesses can be attached one at a time to the mold insert portion which allows the mold insert portion to be fitted to different sizes of mold tubes, a plumb bob attached to a flexible elongated element supported from an extension member, said extension member mounted to the mold insert portion so as to be positioned above the mold insert portion, the plumb bob aligns with a preset mark when the mold insert portion and hence the mold tube is vertically aligned, and an elongated member perpendicular to the mold insert portion, the elongated member having a mark at each end thereof, the marks being aligned with a horizontal elongated element securable to the continuous casting machine so as to be positioned in alignment with the billet receiving rollers to indicate radial and horizontal alignment of the mold insert portion and hence the mold tube, so that the billet issued from the mold tube is aligned with the arcuately positioned billet receiving rollers.

* * * * *